United States Patent [19]

Iain

[11] Patent Number: 4,516,379

[45] Date of Patent: May 14, 1985

[54] DEVICE FOR THE PACKAGING OF POWDER, GRANULATES AND LUMP, PASTY AND LIQUID MATERIALS TO BE PACKAGED BY MEANS OF A TUBULAR FILM

[75] Inventor: Stewart Iain, Wuppertal, Fed. Rep. of Germany

[73] Assignee: Maschinenfabrik Fr. Niepmann GmbH & Co., Gevelsberg, Fed. Rep. of Germany

[21] Appl. No.: 395,947

[22] Filed: Jul. 7, 1982

[30] Foreign Application Priority Data

Jul. 16, 1981 [DE] Fed. Rep. of Germany ..... 3128043

[51] Int. Cl.[3] ..... B65B 61/00

[52] U.S. Cl. ..... 53/138 A; 53/552; 53/417

[58] Field of Search ..... 53/138 A, 417, 551, 53/552, 554; 29/243.56

[56] References Cited

U.S. PATENT DOCUMENTS

| | | | |
|---|---|---|---|
| 1,637,509 | 8/1927 | Allatt | 53/138 A X |
| 3,324,621 | 6/1967 | Runge | 53/551 X |
| 3,380,226 | 3/1968 | Tracy | 53/551 X |
| 3,890,190 | 6/1975 | Eburn | 53/138 A X |
| 4,199,919 | 4/1980 | Moscatelli | 53/552 |
| 4,211,051 | 7/1980 | Tucker | 53/138 A |

FOREIGN PATENT DOCUMENTS

| | | | |
|---|---|---|---|
| 2751089 | 5/1979 | Fed. Rep. of Germany | 53/552 |
| 506546 | 5/1976 | U.S.S.R. | 53/552 |

*Primary Examiner*—John Sipos
*Assistant Examiner*—Steven P. Weihrouch
*Attorney, Agent, or Firm*—Martin A. Farber

[57] ABSTRACT

A device for the packaging of powder, granulates, slurries and viscous materials in a tubular film which is formed from an endless web of film by a forming shoulder into a tube which is filled by means of a filling pipe with the material to be packaged and subdivided at intervals by transverse closures which are formed by a clamp which is moved against the tubular film transverse to the direction of film movement by two cooperating gathering irons which are moved against the tubular film from opposite sides, to gather the tubular film and therby form the transverse closure. In order, despite simple construction, to make considerably higher output possible and at the same time avoid limitations with respect to the minimum length of the tubular bags, two turret disks, driven with uniform rotation in opposite directions to each other, are arranged below the filling pipe in the direction of movement of the tubular film, each of said disks bearing at least one of the gathering irons which cooperate in pairs with each other and which are supported for rotation on the turret disks in such a manner that they are always directed transverse to the direction of movement of the tubular film.

6 Claims, 11 Drawing Figures

Fig. 3
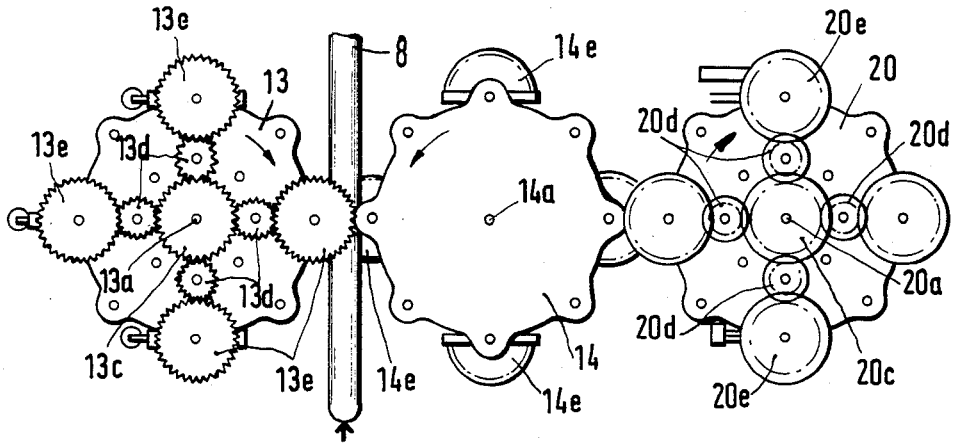
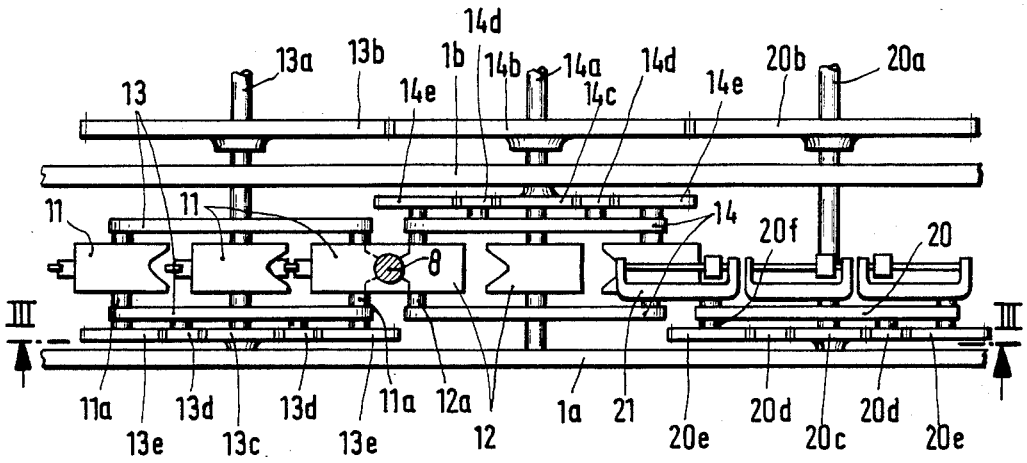
Fig. 2

DEVICE FOR THE PACKAGING OF POWDER, GRANULATES AND LUMP, PASTY AND LIQUID MATERIALS TO BE PACKAGED BY MEANS OF A TUBULAR FILM

The present invention relates to a device for the packaging aging of powder, granulates, slurries and viscous materials in a tubular film which is formed from an endless web of film by a forming shoulder into a tube which is filled by means of a filling pipe with the material to be packaged and subdivided at intervals by transverse closures which are formed by a clip which is moved against the tubular film transverse to the direction of film movement by two cooperating gathering irons which move toward each other from opposite sides against the tubular film to gather the tubular film and thus form the transverse closure.

Devices of the type described above, also known as tubular bag machines, are known in various embodiments.

The movements of the gathering irons which are necessary for the application of the transverse closures formed by clips extend either linearly back and forth transverse to the direction of movement of the tubular film or else move in the manner of a triangular curve in which the vertices of two triangular curves described by the cooperating pairs of gathering irons meet on the tubular film while the movement of the gathering irons back into the starting position takes place approximately parallel to but opposite the direction of movement of the tubular film.

In order to produce the desired movements of the gathering irons, not only are relatively complicated transmissions necessary but, they must also be capable of high accelerations and decelerations, which limit the output of the overall apparatus. Furthermore, for a given speed of the tubular film the minimum length of the packaging bags produced from the tubular film is limited by the known transmissions for driving the gathering irons and their limited speed.

In order to obtain a higher packaging output the tubular film must be driven continuously and the gathering irons moved, together with the tubular film, in the axial direction of the tubular film while also moving towards each other to compress the tubular film, whereby the transverse closures are applied and the gathering irons opened again. As a result of the time which is necessary to bring the gathering members or irons back to their starting position while the tubular film is continuously moved further there is a minimum length of tubular bag which cannot be decreased for a given axial speed of the tubular film.

If, for instance, the gathering irons have an axial stroke in the direction of the length of the tubular bag of 80 mm and during contact of the gathering iron with the tubular film the gathering irons move with the speed of the tubular film, there results a minimum length of tubular bag of two times 80 mm plus the length of the tubular film which results from the advance of the tubular film during the period of standstill for the introduction of the clamps into the gathering irons. By a reduction of the axial stroke of the gathering irons shorter lengths of tubular bag can be produced. In such case, however, the transverse movement of the gathering irons must take place with higher speed. However, there are limits to such options due to the transmission elements used in the known transmissions for the driving of the gathering irons as a result of the accelerations and decelerations required.

The object of the present invention is to avoid the disadvantages of the prior art and to create a device of the above-described type which, while of simple construction, permits a considerably greater output and at the same time is no longer subject to limitations with respect to the minimum length of the tubular bag.

This object is achieved by the invention through provision of two turret disks driven in uniform rotation in opposite direction and arranged below the filling pipe in the direction of movement of the tubular film, each turret disk bearing at least one of the gathering irons which cooperate in pairs and are rotatably mounted on the turret disks in such a manner that the gathering irons are always directed transverse to the direction of movement of the tubular film.

By arranging pairs of-cooperating gathering irons on two turret disks which are driven in uniform rotation and in opposite directions the resulting advantage is that the gathering irons and their drives undergo a uniform rotary movement. The elimination of accelerations and decelerations by such uniform rotary movement not only simplifies the construction of the transmissions but also makes possible a considerable increase in output with respect to the movement of the gathering irons which, in accordance with the invention, are mounted in such a way on the turret disks that they are at all times directed transverse to the direction of movement of the tubular film. The diameter of the turret disks and the number of gathering irons on these turret disks is so selected that the distance between the gathering irons corresponds approximately to the desired length of the tubular bag. It is possible to change both the diameter of the turret disks and the number of gathering irons mounted on them, so that any desired length of tubular bag can be produced with the highest possible speed of transport of the tubular film.

By the use in accordance with the invention of turret disks for the mounting and moving of the gathering irons it is possible, although the invention is not limited thereto, to feed prefabricated clips for the forming of the transverse closures to one of the pairs of cooperating gathering irons while it is in movement. In accordance with the invention, this is done by arranging alongside one of the turret disks an additional disk which is driven in opposite direction from, but with the same speed as, the corresponding turret disk and is provided with supports directed parallel to the gathering irons for the feeding of the clips forming the transverse closure, the number of such supports corresponding to the specific number of gathering irons.

As a result of this additional disk and its development in a manner corresponding to the turret disks it is thus possible to feed prefabricated clips in particularly simple manner to the continuously moving gathering irons so that the feeding of the clips to the gathering irons also does not result in any limitation with respect to the movement of the gathering irons. The clips are transferred to the gathering irons without stopping the gathering irons, such transfer taking place during a time when the uniformly rotating supports and gathering irons cooperate in the manner of the teeth of a pairs of gears. Thus the inactive times for the gathering irons which were necessary in the prior art the eliminated, whereby the output of the apparatus can be furthermore considerably increased.

In accordance with the invention, each support is provided with a carriage which is displaceable in a longitudinal direction and is provided with two pairs of grooves each of which receives a U-shaped clip and into which ejector bars fastened to the support engage during relative movement of the carriage with respect to the support in order to transfer the clips to a gathering iron. As a result of this it is possible to transfer the clips from the support to a gathering iron in a particularly simple manner.

Athough the possibility exists of using prefabricated U-shaped clips, it is a further aspect of the invention to associate a device for producing two U-shaped clips from wire with the additional disk on which device the wires, are cut off by a knife from a roll of wire, are bent by a fork-shaped part of the carriage into U-shape around an anvil and transferred into the pair of grooves of the carriage. Such production of the U-shaped clips in accordance with the invention prior to the reception of the clips by the support arranged on the additional disk results in a decrease in the cost of the parts used for the manufacture of the transverse closures. Instead of using prefabricated and thus expensive clamps, and without any expensive sorting and feeding device, the clips are produced directly from rolls of wire at a rate which directly depends on the operating speed of the apparatus.

In one preferred embodiment of the invention, the wires are fed through fixed guides to a plate provided with slots and both the anvil and the knife which cooperates with the guides are arranged on mounting bolts having a controlled rate of rotation. In accordance with the features of the invention the dependability of operation of the device for the production of the U-shaped clips is assured without entailing a large expense for materials or for control purposes.

As an overall result of the invention there is obtained an apparatus for the packaging of powder, granulates, slurries and viscous materials which, while of simple construction and having an advantageous course of motion, can, regardless of the length of the tubular bag to be produced, always be operated with maximum speed of the tubular film so that its output is independent of the length of the tubular bag.

With the above and other objects and advantages in view, the present invention will become more clearly understood in connection with the detailed description of a preferred embodiment, when considered with the accompanying drawings, of which:

FIG. 2 is a horizontal section along the section line II—II of FIG. 1, showing a top view of the turret disks;

FIG. 3 is a vertical section along the section line III—III of FIG. 2;

Figure 1:
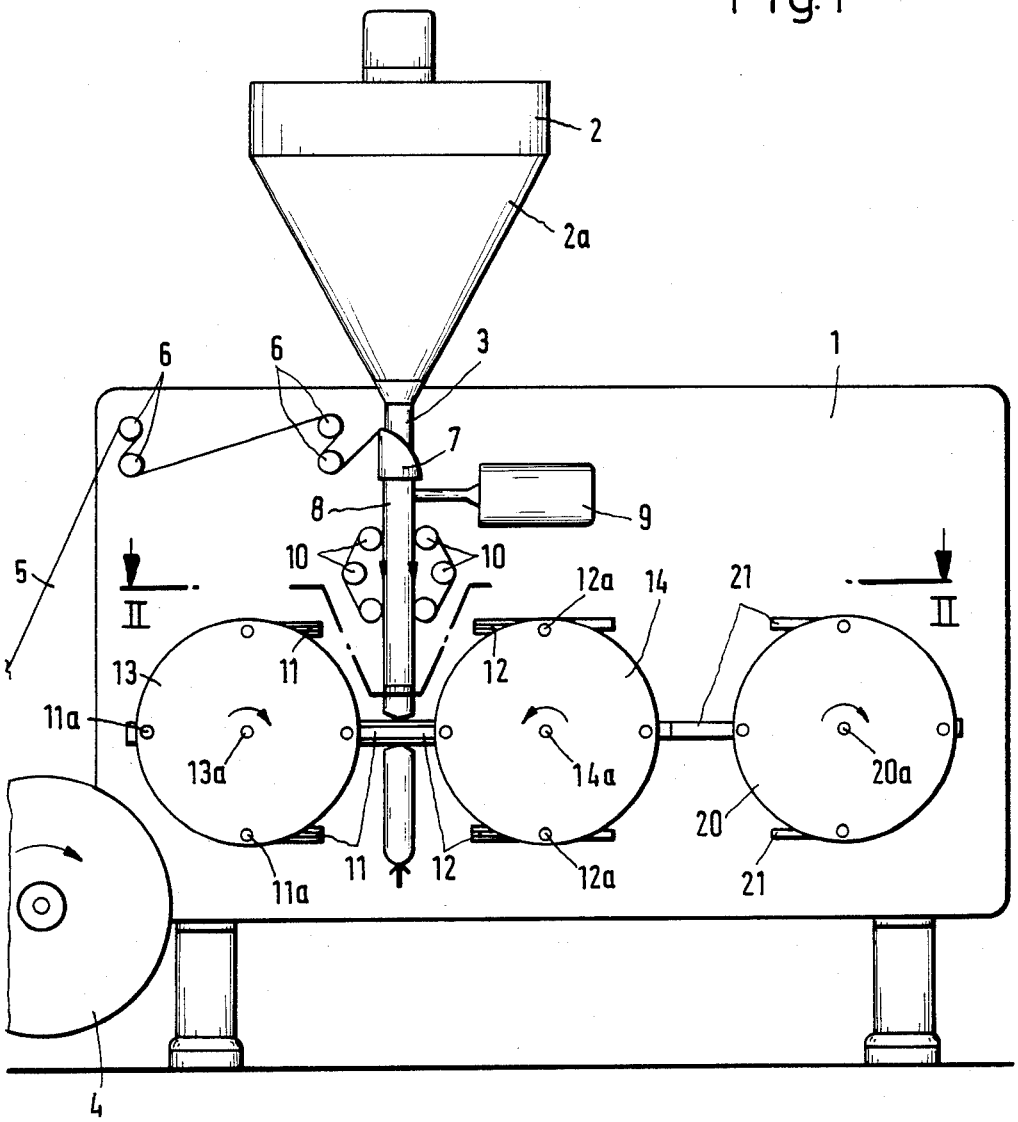
FIG. 1 is a front view of an apparatus incorporating one embodiment of the invention with the front mounting plate and, part of the gearing of the turret disk omitted for greater ease in understanding.

The device for the packaging of powder, granulates, and lump, pasty and liquid materials as shown in FIG. 1, includes a housing 1 which bears a metering device 2 of any desired type. The metering device comprises a filling hopper 2a wich converges into a filling pipe 3 which extends downwardly into the housing 1. The material to be packaged is conducted either continuously or cyclically through the filling pipe 3.

Laterally, alongside the housing 1 is a rotatably supported film roll 4 with a flat web of film 5 wound thereon. The flat web of film 5 is fed, via two pairs of guide rollers 6, to a stationary, forming shoulder 7. Upon passing over this forming shoulder 7 the flat web of film 5 is shaped into a tubular film 8 with overlapping longitudinal edges which surrounds the filling pipe 3. The overlapping longitudinal edges of the tubular film 8 are welded or bonded to each other. In the embodiment shown, an ultrasonic welding device 9 is used which effects a continuous welding together of the edges.

Below the ultrasonic welding device 9 there are two endless traction belts 10 which act on the tubular film 8 which is guided over the filling pipe 3 and continuously advances said tubular film. In cooperation with the material to be packaged, which is introduced by the metering device 2, the traction belts 10 effects a withdrawal of the film 5 from the film roll 4. The tubular film 8, which has been filled with the material to be packaged, is subdivided at the end of the filling tube 3 into individual packages by means of transverse closures. Although a vertical position of the filling pipe 3 and a corresponding position of the associated parts is shown in the illustrative embodiment, the filling pipe 3 may also be horizontal or inclined so that, to this extent also, the embodiment shown in the drawing is to be considered merely as one example.

As transverse closures, clips made of metal are used in the embodiment shown. They can be pre-shaped and fed by a magazine or—as in the embodiment shown—produced directly on the apparatus from wire which is fed to the apparatus in the form of a roll of wire. The production and feeding of the metal clips for the formation of the transverse closures will be described later with reference to FIGS. 6 to 11.

Figure 4:
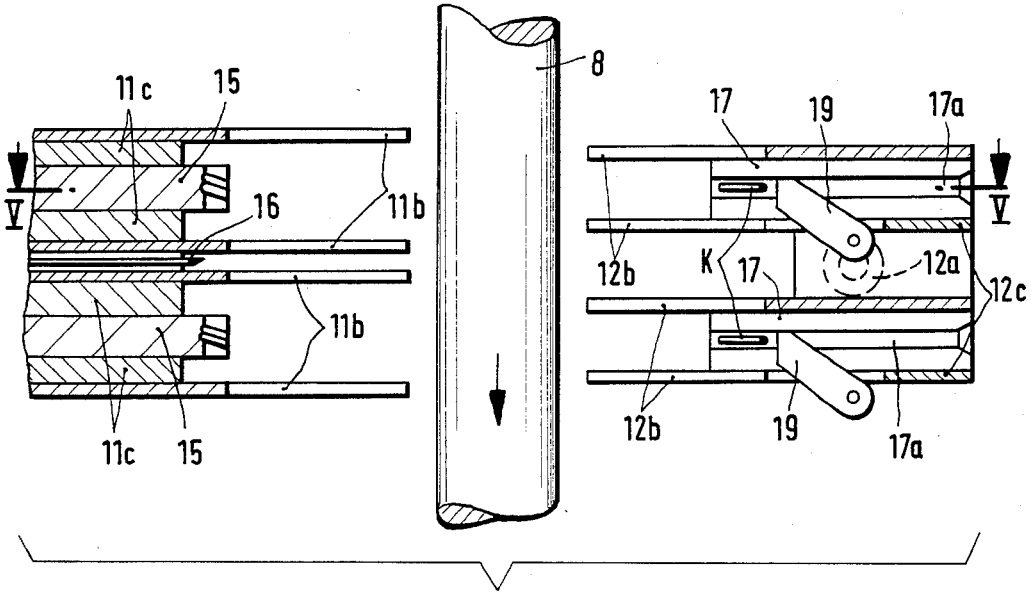
FIG. 4 is an enlarged fragmentary vertical section through the gathering irons which cooperate with the filled tubular film.
Figure 5:
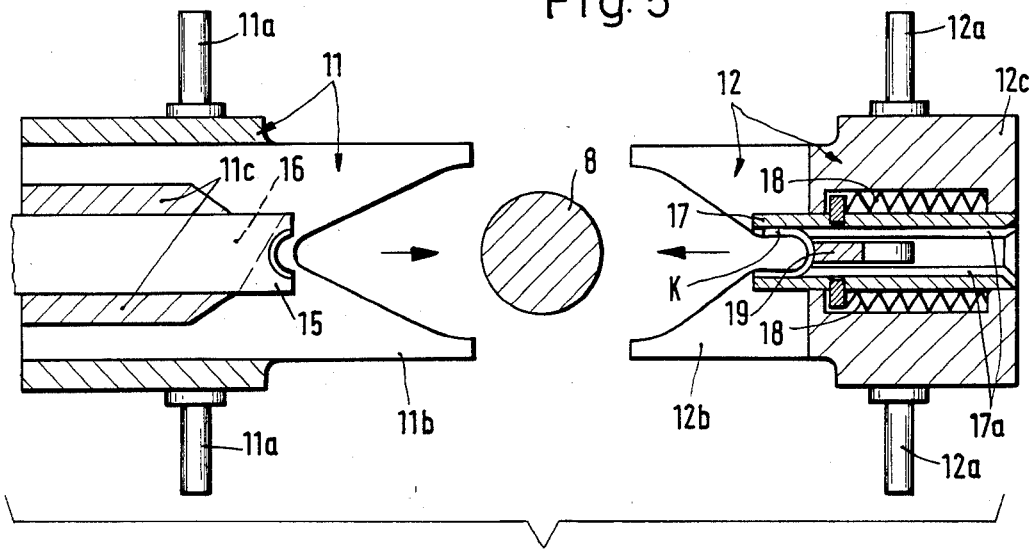
FIG. 5 is a horizontal section along the section line V—V of FIG. 4.

The application of the clips to the tubular film 8 is effected by means of so-called gathering irons 11, 12 which are shown in larger size in FIGS. 4 and 5. The gathering irons 11 and 12 are arranged on turret disks 13 and 14 respectively. The two turret disks 13 and 14 are arranged one on each side of the tubular film 8. The turret disks 13 and 14 on main shafts **13*a* and 14*a* respectively for rotation between a front mounting 1*a* and a rear mounting plate 1*b* of the housing, as best seen in FIG. 2. On the ends of the main shafts 13*a* and 14*a* which protrude towards the rear out of the rear mounting plate 1*b*, drive gears 13*b* and 14*b* respectively are fastened. The drive gears 13*b* and 14*b* meshs with each other so that the two turret disks 13 and 14** turn in opposite directions.

Each turret disk 13 and 14 consists of two disk elements between which are disposed the gathering irons 11 and 12 respectively. In the embodiment shown, both the turret disk 13 and the turret disk 14 bear four gathering irons 11 and 12 respectively. Both the gathering irons 11 and the gathering irons 12 have—as shown in FIG. 5—laterally protruding stub shafts 11*a* and 12*a* respectively by which they are rotatably mounted in the turret disks 13 and 14 respectively.

In order to maintain the gathering irons 11 and 12 horizontal at all times upon the rotation of their turret disks 13 and 14 respectively, a transmission, shown as a gear transmission in the embodiment of the drawing, is arranged on the turret disks 13 and 14 respectively. Instead of the gears shown, however, toothed belts or cam followers with cams can also be used in order to keep the gathering irons 11 and 12 in horizontal position at all times during the rotation of the turret disks 13 and 14. The drive gears 13*b* and 14*b* can also be replaced by toothed belts or chains which ensure that the turret disks 13 and 14 always rotate in opposite direction with the same speed.

In the embodiment shown in FIGS. 2 and 3, the gearings for the gathering irons 11 and 12 comprise sun wheel 13*c* and 14*c* respectively which, while arranged concentrically to the main shafts 13*a* and 14*a* respectively, are connected in non-rotatable manner with the front mounting plate 1*a* and the rear mounting plate 1*b* respectively. The fact that the gearing of the turret disk 13 is arranged on the front side thereof and the gearing for the turret disk 14 on the rear side thereof results from the desire, on the one hand, to obtain a sufficient distance between the gearings and, on the other hand, to improve access to them. With the fixed sun wheels 13*c* and 14*c* there mesh intermediate gears 13*d* and 14*d* respectively which are mounted for rotation on the corresponding turret disks 13 and 14 respectively and effect a reversal in direction of rotation and which, in turn, engage in the planet wheels 13*e* and 14*e* respectively which are fastened on the stub shafts 11*a* and 12*a* respectively of the gathering irons 11 and 12 respectively. The planet wheels 13*e* and 14*e* have the same diameter and the same number of teeth as the sun wheels 13*c* and 14*c* respectively, so that upon rotation of the turret disks 13 and 14 the gathering irons 11 and 12 always remain in horizontal position.

The division of the filled tubular film 8 into individual packages, requires two transverse closures between which the tubular film 8 is separated. Therefore the closures must always by arranged close beside each other, and each gathering iron 11 and 12 has a total of four gathering plates 11*b* and 12*b* respectively which cooperate in pairs as noted from FIGS. 4 and 5. Each gathering plate 11*b* and 12*b* has a V-shaped opening which extends transverse to the direction of travel of the tubular film 8. The gathering plates 11*b* and 12*b* press the tubular film 8 together i.e., gather it to form a thin neck when the corresponding gathering irons 11 and 12 have moved into one another upon a rotation of the two turret disks 13 and 14, as can be noted, for instance, in FIGS. 1 and 2. FIGS. 4 and 5 show the position of two gathering irons 11 and 12 before they act jointly on the tubular film 8.

Between the gathering plates 11*b* of the gathering irons 11 guides 11*c* are provided for a ram 15 and a knife 16. The ram 15 and the knife 16 are movable in an axial direction relative to the gathering plates 11*b*. The gathering irons 12 have a housing 12*c* which is provided with guides and within which holders 17 for the clips K forming the transverse closure are also axially displaceable. The holders 17 having grooves 17*a* for feeding of the clips K. The holders 17 are under the action of compression springs 18 and cooperate with spring-loaded levers 19 which, upon a feeding of a clip K to the front end of the holder 17, are pressed back in counter-clockwise direction but due to their spring loading return into the position shown in FIG. 4, in which they prevent the clips K which have already been introduced from being pushed back, best seen in FIG. 5.

As soon as the gathering irons 11 and 12 have pressed the tubular film 8 together, the rams 15 and the holders 17 are moved towards each other relative to the gathering plates 11*b* and 12*b* respectively. At the same time, two clips K surround the tubular film 8 which has been compressed to form a narrow neck. The originally parallel arms of the clips K, after gripping around the compressed tubular film 8, are deformed by the corresponding ram 15 so that the clamp K forms a closed ring, the ends of which overlap somewhat. In this manner the tubular film 8 is closed at two places by the clips K. Between the two transverse closures the tubular film is cut by the knife 16 so that when the two gathering irons 11 and 12 then move apart a closed package is present and at the same time the next package to be filled is closed at its lower end. The relative movement of the rams 15, knives 16 and holders 17 is effected by cams, not shown in the drawing. The cams, in cooperation with the compression springs 18, ensure that the movements take place synchronously and that, the holders 17 which have been pressed together by the rams 15 upon the moving together of the gathering irons 11, 12 are pushed forward relative to their gathering plates 12*b* when the gathering irons 11 and 12 move apart. Thus the clips K which have been shaped into a ring do not remain stuck between the gathering plates 12*b* but emerge from the V-shaped opening of the gathering plate 12*b*.

Although preformed clamps K can be fed through the grooves 17*a* to the holder 17, the illustrative embodiment shows a device in which the two clamps K are each produced on the apparatus from a roll of wire.

For the purpose of producing clips, an additional disk 20 is arranged, alongside of the turret disk 14 and driven from a main shaft 20*a*. In addition a drive gear 20*b* is seated on the main shaft 20*a* and meshes with the drive gear 14*b* of the turret disk 14, so that the two disks 14 and 20 rotate with the same speed but in opposite directions.

Coaxial to the main shaft 20*a* there is mounted on the front mounting plate 1*a* a sun wheel 20*c* on which there travel intermediate gears 20*d* which are mounted for rotation on the additional disk 20. These intermediate gears 20*d* in their turn drive planet wheel 20*e* which have the same diameter and the same number of teeth as the sun wheel 20*c* and therefore ensure that supports 21 fastened on a shaft 20*f* of the planet wheels 20*e* always extend horizontally, in the same manner as the gathering irons 11 and 12, when the additional disk 20 rotates. The construction of the supports 21 and of the corresponding parts for the production of the clamps K is shown in FIGS. 6 to 11.

A guide bar 22 is fastened the support 21 for movably guiding a carriage 23 disposed thereon. The carriage 23 has a roller 23*a* which travels in a guide groove 21*a* of the support 21 in order to prevent the turning of the carriage 23 with respect to the support 21 around the central axis of the guide bar 22. In order to prevent axial movement of the carriage 23 in the longitudinal direction of the guide bar 22, there is also provided a latch 24 which is mounted for rotation around a pin 24*a* on the support 21. The latch 24 is under the force of a spring (not shown) which urges the latch 24 in a clockwise direction.

Figure 8:
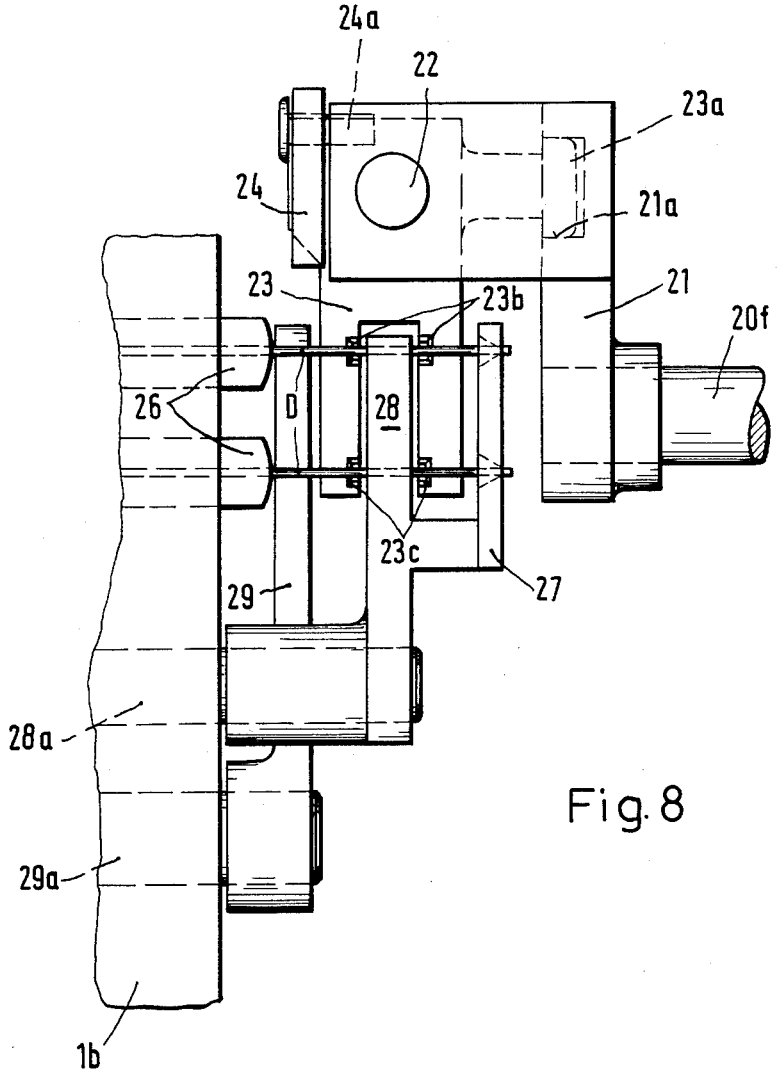
FIG. 8 is a side view of the apparatus of FIGS. 6 and 7 in the direction of the arrow VIII in FIG. 6.

The carriage 23 is of fork-shaped development in its lower region, as best seen in FIG. 8. Within the fork-shaped region two pairs of grooves 23*b* and 23*c* are formed each of which serves to receive a clip K. The clips K are pushed out of the pairs of grooves 23*b* and 23*c* upon movement of the carriage 23 in the direction towards the shaft 20*f* by ejection bars 25. The ejection bars 25 are fastened to the support 21, as noted in FIG. 6.

In order to produce the clips K, wires D are withdrawn from wire rolls (not shown) and conducted through guides 26. The front end of the wires D is brought up into a plate 27 which is provided with two slots 27*a* arranged spaced and parallel from each other. Parallel to the plate 27 there is an anvil 28 which is fastened on a mounting bolt 28*a*, fixed in space, and swingable by the mounting bolt 28*a*. FIG. 8 shows that the mounting bolt 28*a* is mounted in the rear mounting plate 1*b*. The mounting plate 1*b* serves also for mounting of a mounting bolt 29*a* on which there is fastened a knife 29 which extends parallel to the anvil 28 directly in front of the guides 26.

Figure 6:
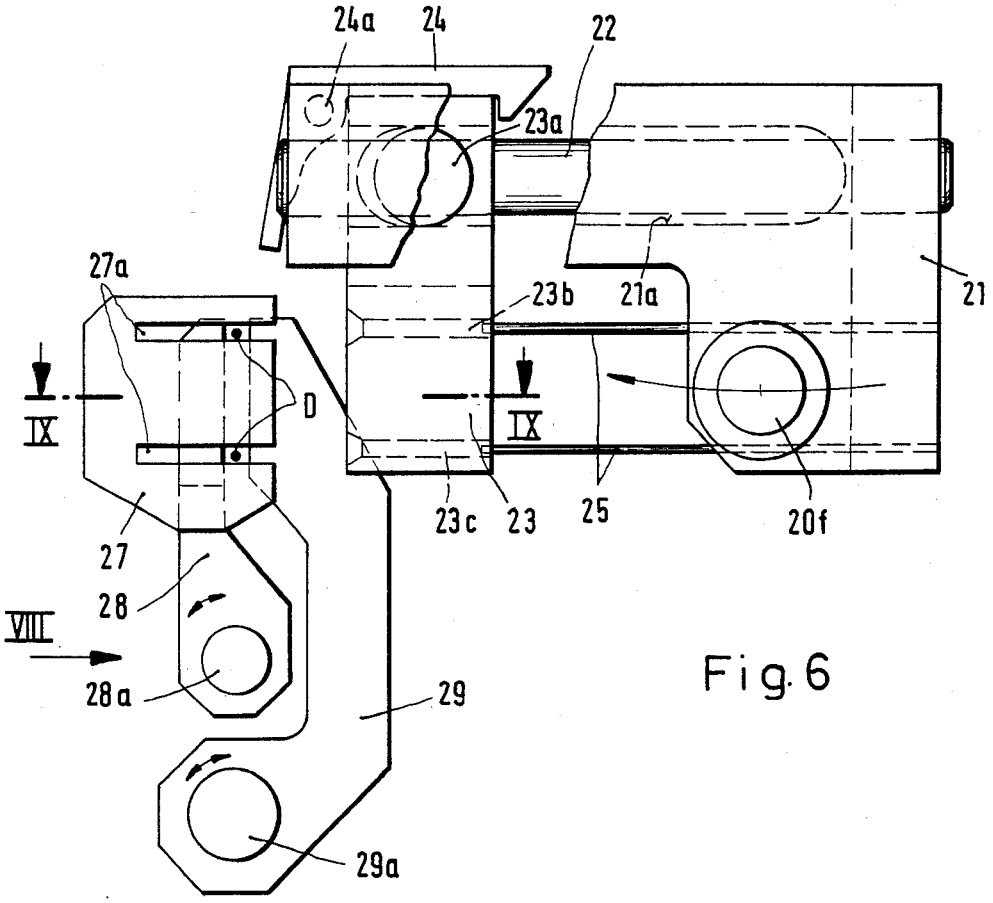
FIG. 6 is an enlarged fragmentary view showing the production of clamps as seen in a horizontal direction.
Figure 7:
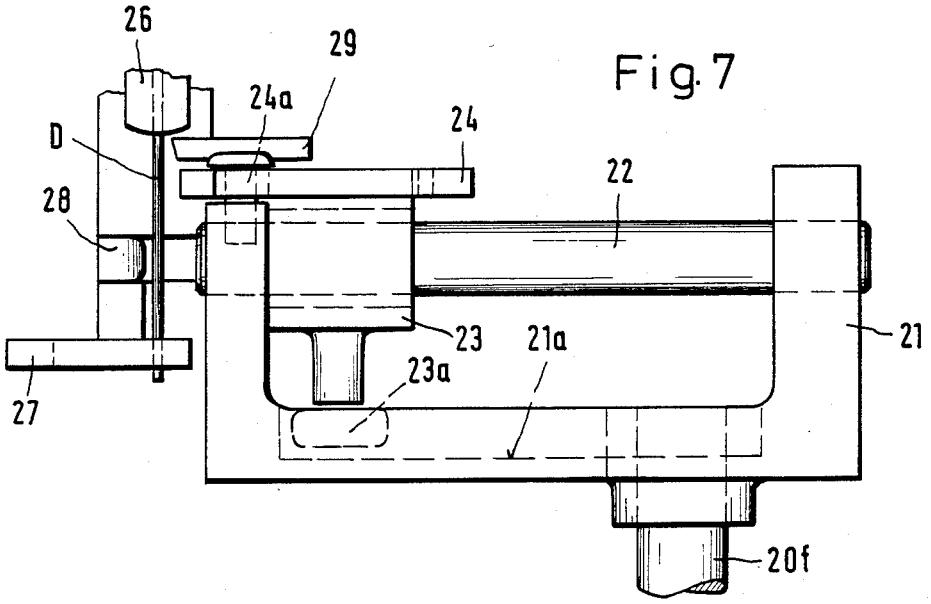
FIG. 7 is a top view of the apparatus of FIG. 6.

FIGS. 6 to 8 show two wires D shortly before they are cut by the knife 29 and then bent to form a clip K. The course of the cutting and bending is shown in detail in FIGS. 9 and 10.

Figure 9:
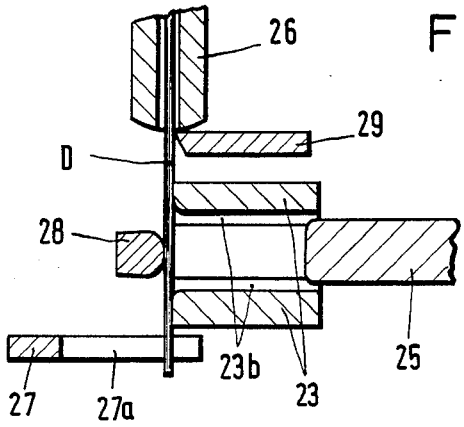
FIG. 9 is a horizontal section along the section line IX—IX of FIG. 6.
Figure 10:
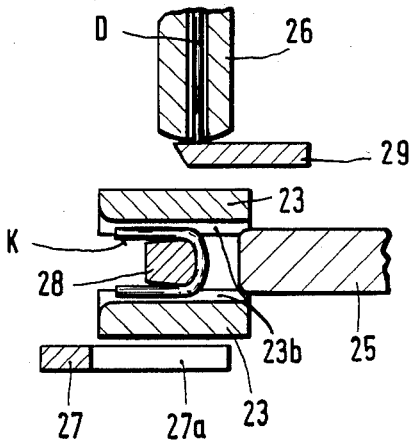
FIG. 10 shows the structure of FIG. 9 in a different operating position.

FIG. 9 is an enlarged view in section of a part of FIG. 7; in combination with FIG. 10, which is drawn in a different position of the individual parts, and further details the process for manfacture of a clip K from a wire D.

FIG. 9 shows a position in which the carriage 23 has just come against the wire D, which has been pulled out of the guide 26 into the region of a slot 27*a* in the plate 27. Upon further movement of the carriage 23, the knife 29 cuts the wire D at the mouth of the guide 26. The wire D which has been cut off is bent by the fork-shaped part of the carriage 23 around the stationary anvil 28, as shown in FIG. 10. Whereas the web of the clip K which is formed lies on the front side of the anvil 28, the arms of the clip K enter into a pair of grooves 23*b* in the carriage 23 so that the completely bent clip K lies in the region of the pair of grooves 23*b* within the carriage 23. The anvil 28 is now swung in a counterclockwise direction by the mounting bolt 28*a* so that the support 21 and the carriage 23 move further and the finished clip K can be forced out of the carriage by the ejector bar 25 as soon as the support 21 engages a gathering iron 12.

Figure 11:
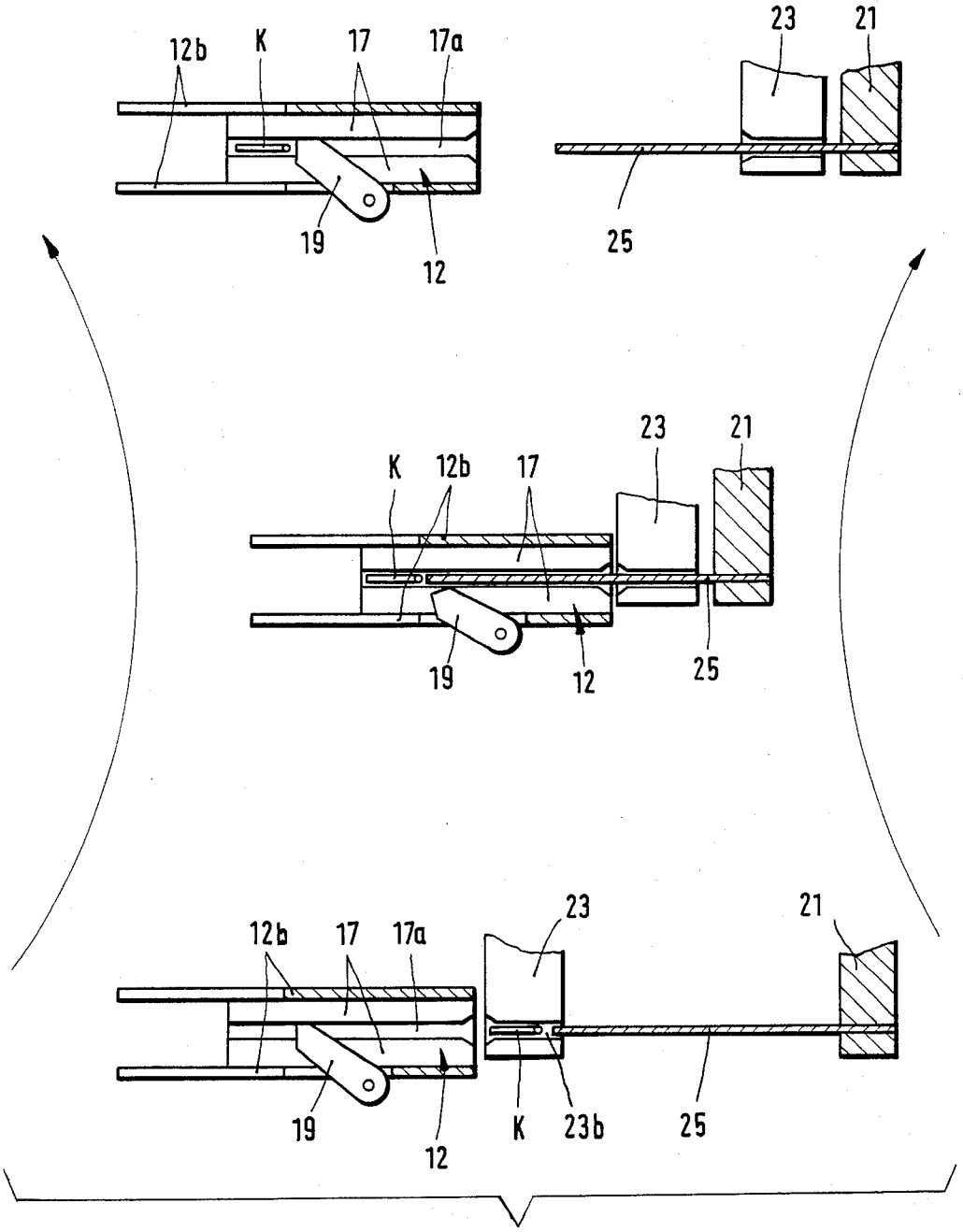
FIG. 11 illustrates a course of motion represented by three different positions showing the transfer of a clip from the device of FIGS. 6 to 10 to a gathering iron of a turret disk.

FIG. 11 shows the synchronization of movement of ejection of the clip K out of the carriage 23 with the movement of a corresponding gathering iron 12 in order to show how the clips K produced on the additional disk 20 enter the gathering irons 12 which are mounted on the turret disk 14.

In the lower of the three positions shown in FIG. 11 it can be noted that a completely bent clip K is present within the carriage 23. Before the facing surfaces of the gathering iron 12 and carriage 23 comes together, the latch 24 is swung by the gathering iron 12 so that the carriage 23 is released for displacement by means of the gathering iron 12 on the guide bar 22. Upon rotation of the additional disk 20 in a clockwise direction in accordance with the arrow shown on the right in FIG. 11, the ejector bar 25 which is fastened to the support 21 presses the clip K out of the pair of grooves 23*b* into the corresponding grooves 17*a* of the holder 17 of the gathering iron 12 which is oppositely disposed on the turret disk 14 and moves in the direction of the left-hand arrow in FIG. 11. Two gathering iron plates 12*b* of the gathering iron 12, the holder 17 lying between said plates and the spring-loaded lever 19 can be noted in FIG. 11. The lever 19 is pressed, against the force of its spring (not shown), by the clip K in counterclockwise direction when the clip K moves forward into the grooves 17*a* of the holder 17. The backward-pressed position of the lever 19 can be noted in the middle position in FIG. 11. The upper position shows that the lever 19 returns into its starting position as soon as the clip K has passed the lever 19 and the ejector bar 25 has been again withdrawn out of the grooves 17*a* of the holder 17. The relative movement between the parts of the gathering iron 12 and the support 21 is effected by the turning of the turret disk 14 and the additional disk 20, as indicated by the two arrows in FIG. 11.

After clips K have been produced on the supports 21 of the additional disk 20 in accordance with the above description of FIGS. 6 to 10, the clips K pass, as shown in FIG. 11, into the corresponding gathering irons 12. The clips K are held fast in the grooves 17*a* of the holders 17 by the levers 19 so that upon the cooperation of the gathering irons 12 with the gathering irons 11 arranged on the turret disks 13, in accordance with the description of FIGS. 4 and 5, two transverse closures are produced simultaneously by the clips K. The clamps K close a filled section of the tubular film 8 at the upper end and form the lower closure for a section of the tubular film 8 to be filled before the tubular film 8 is cut between the two transverse closures by means of the knife 16.

The drawings which have been described above with respect to their details show that the synchronously rotating turret disks 13 and 14, by their gathering irons 11 and 12, effect a pressing together of the tubular film 8 and the application, in each case, of two transverse closures, without couplings or other control members having to be actuated. The processes are effected solely by the synchronous movement of the rotating turret disks 13 and 14 in cooperation with the at all times horizontal position of the gathering irons 11 and 12. The production of the clips K from wire on the additional disk 20 also does not require any expensive control measures and takes place synchronously with the rotation of the turret disks 13 and 14 so that, the transfer of the clips K from the additional disk 20 to the gathering irons 12 of the turret disk 14 also takes place in a particularly simple and reliable manner.

I claim:

1. In a device for the packaging of powder, granulates, slurries and viscous materials in a tubular film which is formed from an endless web of film by a forming shoulder into a tube which is filled by means of a filling pipe with the material to be packaged and subdivided at intervals by transverse closures which are each formed by a clip which is brought against the tubular film transverse to the direction of film movement by two cooperating gathering members which are brought against the tubular film from opposite sides to gather the tubular film and thereby form the transverse closure, the improvement wherein two turret discs are arranged downstream of the filling pipe in the direction of movement of the tubular film and are driven in uniform rotation in opposite directions relative to each other, each of said turret discs carrying at least one of said gathering members which cooperate in pairs with each other, and means for rotatably mounting the gathering members on said turret discs so as to be always oriented transversely to the direction of movement of the tubular film, an additional disc arranged alongside one of the turret discs and means for driving said additional disc in opposite direction to, but with the same speed as, said one turret disc, said additional disc being provided with means for feeding clips which form the transverse closures, to the gathering members on said one turret disc, said clip feeding means include support means on said additional disc extending parallel to the gathering members on said one turret disc, the number of said support means on said additional disc corresponding to the specific number of gathering members on said one turret disc, said clip is U-shaped and each said support means is provided with a carriage which is displaceable in a longitudinal direction parallel to the transverse direction of movement of the gathering members, said support means having two pairs of grooves, each said pair of grooves to receive one of said U-shaped clips, ejector bars fastened to the support means for entry into respective pairs of said grooves upon relative movement of the carriage with respect to the support means, to transfer the clips to one of said gathering members while said discs are in motion.

2. The device according to claim 1, wherein the carriage has a fork shaped portion and the additional disc includes means for producing two U-shaped said clips from wire, said clip producing means comprising cutting means for cutting the wire for each clip from a roll of wire, an anvil for bending the wire into U-shape in cooperation with the fork-shaped portion of the carriage, and means for transferring the U-shaped clips into the respective pairs of grooves of the carriage.

3. The device according to claim 2, wherein the cutting means is a knife.

4. The device according to claim 2, wherein the clip producing means include stationary guides and a plate provided with slots and the wire is fed through the stationary guides to the plate provided with slots and wherein both the anvil and the cutting means cooperates with the guides.

5. The device according to claim 4, wherein the anvil and the cutting means are arranged on respective mounting bolts which can be turned in controlled manner.

6. The device according to claim 1, wherein said members comprise plates.

* * * * *